US007063073B2

(12) United States Patent
Ausiello et al.

(10) Patent No.: US 7,063,073 B2
(45) Date of Patent: Jun. 20, 2006

(54) METHOD FOR THE DIRECT INJECTION OF FUEL INTO AN INTERNAL COMBUSTION ENGINE

(75) Inventors: Francesco Ausiello, Bologna (IT); Gabriele Serra, San Lazzaro Di Savena (IT)

(73) Assignee: Magneti Marelli Powertrain, S.p.A., Corbetta (IT)

( * ) Notice: Subject to any disclaimer, the term of this patent is extended or adjusted under 35 U.S.C. 154(b) by 0 days.

(21) Appl. No.: 11/128,687

(22) Filed: May 12, 2005

(65) Prior Publication Data

US 2005/0257772 A1 Nov. 24, 2005

(30) Foreign Application Priority Data

May 20, 2004 (IT) ..... BO2004A0323

(51) Int. Cl.
*F02M 33/00* (2006.01)

(52) U.S. Cl. ..... 123/446; 123/506; 123/500

(58) Field of Classification Search ..... 123/446, 123/447, 506, 500–503
See application file for complete search history.

(56) References Cited

U.S. PATENT DOCUMENTS 4,777,921 A * 10/1988 Miyaki et al. ..... 123/456
5,277,156 A * 1/1994 Osuka et al. ..... 123/198 DB
5,697,343 A * 12/1997 Isozumi et al. ..... 123/446
5,771,864 A * 6/1998 Morishita et al. ..... 123/456
6,095,118 A * 8/2000 Klinger et al. ..... 123/446
6,311,674 B1 * 11/2001 Igashira et al. ..... 123/458
6,343,588 B1 2/2002 Onishi et al.
6,546,918 B1 * 4/2003 Onishi et al. ..... 123/506
6,640,788 B1 * 11/2003 Inoue et al. ..... 123/506
6,745,753 B1 * 6/2004 Spinnler et al. ..... 123/509
6,899,084 B1 * 5/2005 Miyashita ..... 123/446

FOREIGN PATENT DOCUMENTS

| | | |
|---|---|---|
| EP | 0 501 459 | 9/1992 |
| EP | 0 962 650 | 12/1999 |
| EP | 1 130 250 | 9/2001 |
| EP | 1 241 338 | 9/2002 |

* cited by examiner

*Primary Examiner*—Thomas Moulis
(74) *Attorney, Agent, or Firm*—Klarquist Sparkman, LLP

(57) ABSTRACT

A method for the direct injection of fuel into an internal combustion engine, wherein a high-pressure pump with a variable flow rate supplies the fuel to a common rail, which in turn supplies the fuel to a series of injectors; the flow rate of the high-pressure pump is controlled by choking each pump stroke by varying the closure time of an intake valve of said high-pressure pump; the mechanical actuation of the high-pressure pump is timed so that each injection interval is located at the beginning of a respective choking action; and each pump stroke is choked by at least an angular interval having a duration no shorter than that of the injection intervals irrespective of the quantity of fuel to be supplied to the common rail in such a way that the injection phase of each injector always takes place when the high-pressure pump is not pumping fuel to the common rail.

10 Claims, 5 Drawing Sheets

METHOD FOR THE DIRECT INJECTION OF FUEL INTO AN INTERNAL COMBUSTION ENGINE

CROSS REFERENCE TO RELATED APPLICATION

This application claims priority under 35 U.S.C. § 119 from Italian Patent Application No. B02004A 000323, filed May 20, 2004. The prior application is incorporated herein by this reference.

The present invention relates to a method for the direct injection of fuel into an internal combustion engine, in particular for direct fuel injection of the common rail type.

BACKGROUND OF THE INVENTION

In current common-rail type direct injection systems, a low-pressure pump supplies fuel from a tank to a high-pressure pump, which in turn supplies the fuel to a common rail. A series of injectors (one for each cylinder of the engine) is connected to the common rail, said injectors being driven cyclically in order to inject part of the pressurised fuel present in the common rail into a respective cylinder. If the injection system is to operate correctly, it is important for the fuel pressure level within the common rail constantly to be maintained at a desired value that generally varies over time; to this end, the high-pressure pump is dimensioned so as to supply the common rail in any operating state with a quantity of fuel that exceeds actual consumption and a pressure regulator is coupled to the common rail, which regulator maintains the fuel pressure level within the common rail at the desired value by discharging excess fuel to a recirculation channel that reintroduces said excess fuel upstream from the low-pressure pump.

Known injection systems of the type described above have various disadvantages, because the high-pressure pump must be dimensioned so as to supply the common rail with a quantity of fuel that slightly exceeds the maximum possible consumption; however, this maximum possible consumption state occurs relatively rarely and in all other operating states the quantity of fuel supplied to the common rail by the high-pressure pump is much greater than that actually consumed and thus a considerable proportion of said fuel must be discharged by the pressure regulator into the recirculation channel. Obviously, the work performed by the high-pressure pump in pumping fuel that is subsequently discharged by the pressure regulator is "pointless" work and such known injection systems accordingly have very low energy efficiency. Moreover, such known injection systems have a tendency to overheat the fuel, because when the excess fuel is discharged by the pressure regulator into the recirculation channel, said fuel passes from a very high pressure (greater than 1000 bar) to a substantially ambient pressure and this pressure drop tends to increase the temperature of the fuel. Finally, known injection systems of the type described above are relatively bulky owing to the presence of the pressure regulator and the recirculation channel connected to the pressure regulator.

In order to overcome the problems described above, a solution has been proposed of the type presented in patent application EP0481964A1, which describes the use of a high-pressure pump with a variable flow rate, which is capable of supplying the common rail with only the quantity of fuel that is necessary to maintain the fuel pressure within the common rail at the desired value; in particular, the high-pressure pump is equipped with an electromagnetic actuator capable of instantaneously varying the flow rate of the high-pressure pump by varying the closure time of an intake valve of the high-pressure pump itself.

Another embodiment of a high-pressure pump with a variable flow rate is described by patent U.S. Pat. No. 6,116,870A1. In particular, the high-pressure pump described by U.S. Pat. No. 6,116,870A1 comprises a cylinder provided with a piston that has reciprocating motion within the cylinder, an intake channel, a delivery channel coupled to the common rail, an intake valve capable of permitting fuel to flow into the cylinder, a non-return delivery valve coupled to the delivery channel and capable only of permitting fuel to flow out of the cylinder, and a regulating device coupled to the intake valve in order to keep the intake valve open during a compression phase of the piston and so permit the fuel to flow out of the cylinder through the intake channel. The intake valve comprises a valve body that is mobile along the intake channel and a valve seat, which is capable of being acted upon in a fluid-tight manner by the valve body and is located at the opposite end of the intake channel from that communicating with the cylinder. The regulating device comprises an actuating body, which is coupled to the valve body and can move between a passive position, in which it permits the valve body to act in a fluid-tight manner upon the valve seat, and an active position, in which it does not permit the valve body to act in a fluid-tight manner upon the valve seat; the actuating body is coupled to an electromagnetic actuator, which is capable of displacing the actuating body between the passive position and the active position.

As stated above, in the above-described high-pressure pumps with a variable flow rate, the flow rate of a high-pressure pump is varied by varying the closure time of the intake valve of said high-pressure pump; in particular, the flow rate is reduced by delaying the closure time of the intake valve and is increased by advancing the closure time of the intake valve.

In general, the above-described high-pressure pumps with a variable flow rate have two cylinders, along each of which there runs a piston that completes one cycle (i.e. performs an intake stroke and a pumping stroke) for every two revolutions of the drive shaft; thus, for every two complete revolutions of the drive shaft, the high-pressure pump makes two pump strokes (one for each cylinder of the high-pressure pump). In a four-cylinder, four-stroke internal combustion engine, for each complete revolution of the drive shaft, one pump stroke of the high-pressure pump and the injection phase of two injectors take place. When the required flow rate is equal or close to the maximum flow rate of the pump, both the injectors performing the injection phase during any one revolution of the drive shaft inject the fuel while a piston of the high-pressure pump is pumping the fuel into the common rail; when the required flow rate is less than the maximum flow rate of the high-pressure pump, the pump stroke is choked and thus a first one of the injectors performing the injection phase during any one revolution of the drive shaft injects the fuel while neither piston of the high-pressure pump is pumping fuel into the common rail, whereas a second one of the injectors performing the injection phase during any one revolution of the drive shaft injects the fuel while one piston of the high-pressure pump is pumping fuel into the common rail. The disparity described above, which arises between the two injectors performing the injection phase during the same revolution of the drive shaft results in a disparity in the quantity of fuel injected by the two injectors with an identical injection time, with obvious repercussions on the correct operation of the engine; moreover, this disparity does not always occur to the same extent, but there is a substantial difference when the required flow rate from the high-pressure pump is lower than a certain threshold value corresponding to the value at which choking of the high-pressure pump coincides with the beginning of the injection phase of the first injector to inject, out of the two injectors performing the injection phase during the same revolution of the drive shaft.

In order to overcome the above-described disadvantage, at least in part, it has been proposed to use a high-pressure pump with a variable flow rate having two cylinders, along each of which there runs a piston that completes one cycle (i.e. performs an intake stroke and a pumping stroke) for each revolution of the drive shaft. Thus, in a four-cylinder, four-stroke internal combustion engine, for each complete revolution of the drive shaft, two pump strokes of the high-pressure pump and the injection phase of two injectors take place; in this manner, just one injection phase of one of the injectors always takes place during each pump stroke of the high-pressure pump. When the required flow rate is equal or close to the maximum flow rate of the pump, all the injectors inject the fuel while one piston of the high-pressure pump is pumping fuel into the common rail; when the required flow rate is less than the maximum flow rate of the high-pressure pump, the pump stroke is choked and all the injectors inject the fuel while neither piston of the high-pressure pump is pumping fuel into the common rail. Obviously, the disparity in the behaviour of the injectors is reduced because, within any one control interval, either all the injectors perform injection while one piston of the high-pressure pump is pumping fuel into the common rail, or all the injectors perform injection while neither piston of the high-pressure pump is pumping fuel into the common rail; nevertheless, a slight disparity in behaviour remains in that in some control intervals the injectors have certain dynamic characteristics because they are injecting while one piston of the high-pressure pump is pumping fuel into the common rail, whereas in other control intervals the injectors have different dynamic characteristics because they are injecting while neither piston of the high-pressure pump is pumping fuel into the common rail.

Moreover, making the pistons of the high-pressure pump perform one cycle (i.e. an intake stroke and a pumping stroke) on each revolution of the drive shaft instead of one cycle every two revolutions of the drive shaft entails doubling the average velocity of said pistons with obvious problems of mechanical strength and reliability over time. Alternatively, it has been proposed to use high-pressure pumps equipped with four cylinders and thus with four pistons, each of which performs one cycle every two revolutions of the drive shaft; however, while this solution is more straightforward to implement, it involves substantially higher costs and bulkiness of the high-pressure pump.

EP1130250A1 discloses a pump having a housing with working chamber, reciprocally moving piston rotatably mounted about its longitudinal axis and at least one inlet opening; opening in piston casing is connected to working chamber, interacts with inlet opening and is designed so liquid flowing into working chamber can be adjusted to turn the piston, which has radial groove with radial depth of at least one percent of piston diameter. The pump has a pump housing with a working chamber, a reciprocally moving piston rotatably mounted about its longitudinal axis and at least one inlet opening; an opening in the piston casing is connected to the working chamber, interacts with the inlet opening and is designed so the liquid flowing into the working chamber can be adjusted to turn the piston. A groove extending along the periphery of the piston has a radial depth amounting to at least one percent of the piston diameter.

EP0501459A1 discloses a common-rail fuel injection system for an engine including a common rail for storing fuel; a plurality of pumps supply fuel to the common rail. Fuel is injected into the engine from the common rail and feedback control is executed on the pressure of the fuel in the common rail; a device serves to detect whether or not at least one of the pumps fails and an arrangement decreases the pressure of the fuel in the common rail when the detecting device detects that at least one of the pumps fails.

EP1241338A1 discloses a fuel supply system, which reduces the unevenness of injection rates of cylinders in a fuel supply system of a direct injection engine which uses a variable displacement single plunger pump; the unevenness of injection rates of cylinders can be reduced by constructing so that the cam which drives the high-pressure fuel pump may make one reciprocation while the engine makes explosions by two cylinders and causing the controller to extend the injection time width of one of two injectors which inject while one discharge of the high-pressure fuel pump and to shorten the injection time width of the other injector.

EP0962650A1 discloses an accumulator-type fuel injection apparatus having a plurality of fuel injection valves for corresponding individual cylinders of an engine; the fuel injection valves are connected to a common pressure-accumulator chamber that is connected to an ejection side of a fuel pump. Fuel is pumped from the fuel pump into the pressure-accumulator chamber and then supplied into the cylinders via the corresponding fuel injection valves; the fuel pumping timing of the fuel pump is set relative to the fuel injection timing so that a variation in fuel pressure in the pressure-accumulating chamber at the time of start of a fuel injecting operation is smaller than a predetermined set value.

SUMMARY OF THE INVENTION

The aim of the present invention is to provide a method for the direct injection of fuel into an internal combustion engine, which method does not have the above-stated disadvantages and, in particular, is simple and economic to implement.

The present invention provides a method for the direct injection of fuel into an internal combustion engine as recited in the attached claims.

BRIEF DESCRIPTION OF THE DRAWINGS

The present invention will now be described with reference to the attached drawings, which illustrate some non-limiting embodiments thereof, in which.

DETAILED DESCRIPTION OF THE INVENTION

Figure 1:
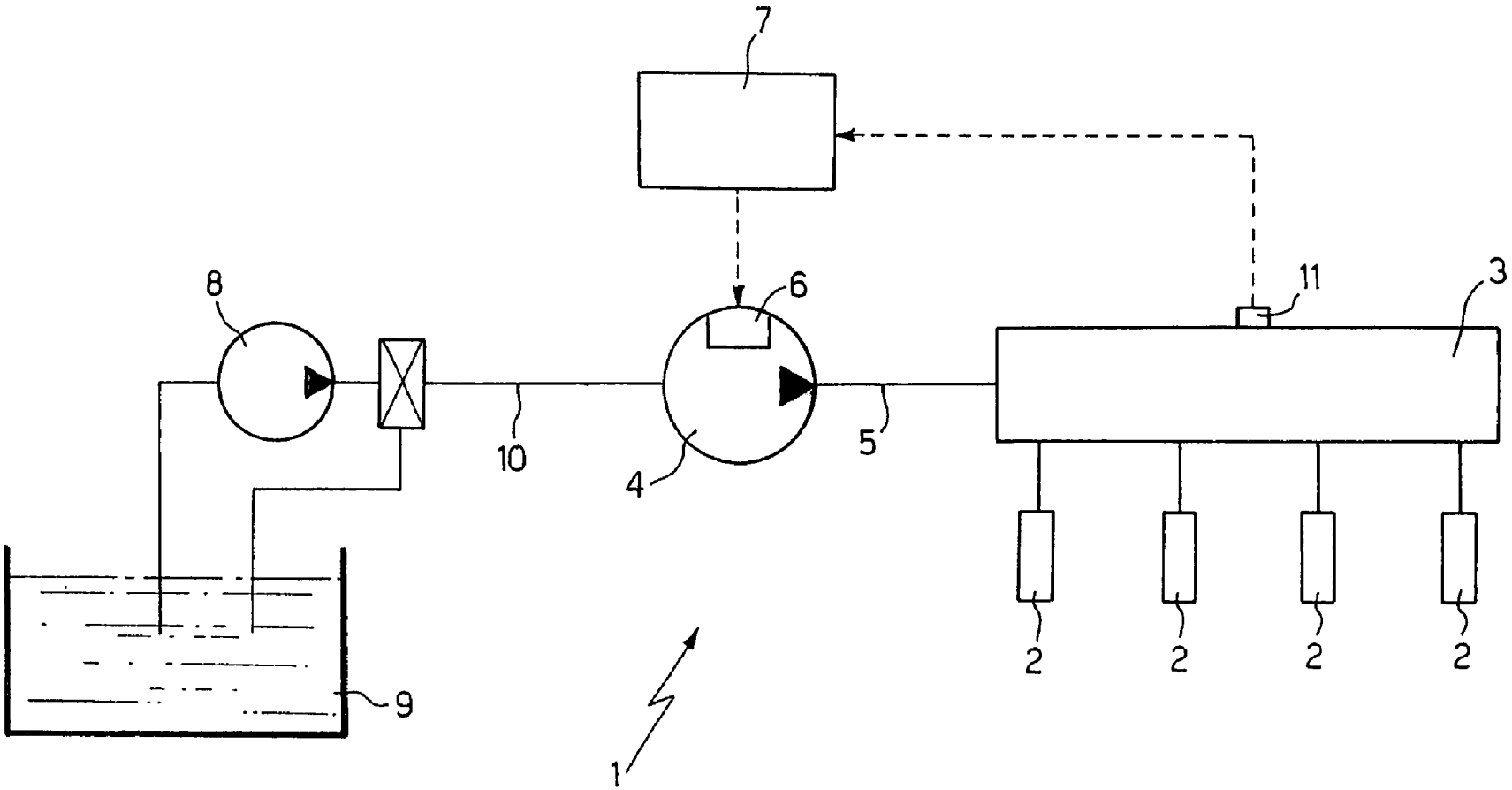
FIG. 1 is a diagrammatic view of a common-rail type direct fuel injection system produced according to the present invention.

In FIG. 1, 1 denotes an overall common-rail type system for the direct injection of fuel into an internal combustion engine provided with four cylinders (not shown in detail). The injection system 1 comprises four injectors 2, each of which is capable of injecting fuel directly into the crown of a respective cylinder (not shown in detail) of the engine and receives the pressurised fuel from a common rail 3. A high-pressure pump 4 supplies the fuel to the common rail 3 by means of a tube 5 and is equipped with a device 6 for regulating flow rate driven by a control unit 7 capable of maintaining the fuel pressure within the rail 3 at a desired value, which is generally variable over time as a function of the operating conditions of the engine. A low-pressure pump 8 with a substantially constant flow rate supplies the fuel from a tank 9 to the high-pressure pump 4 by means of a tube 10.

In general, the control unit 7 regulates the flow rate of the high-pressure pump 4 by means of feedback control using as the feedback variable the fuel pressure level within the common rail 3, said pressure level being detected in real time by a sensor 11.

Figure 2:
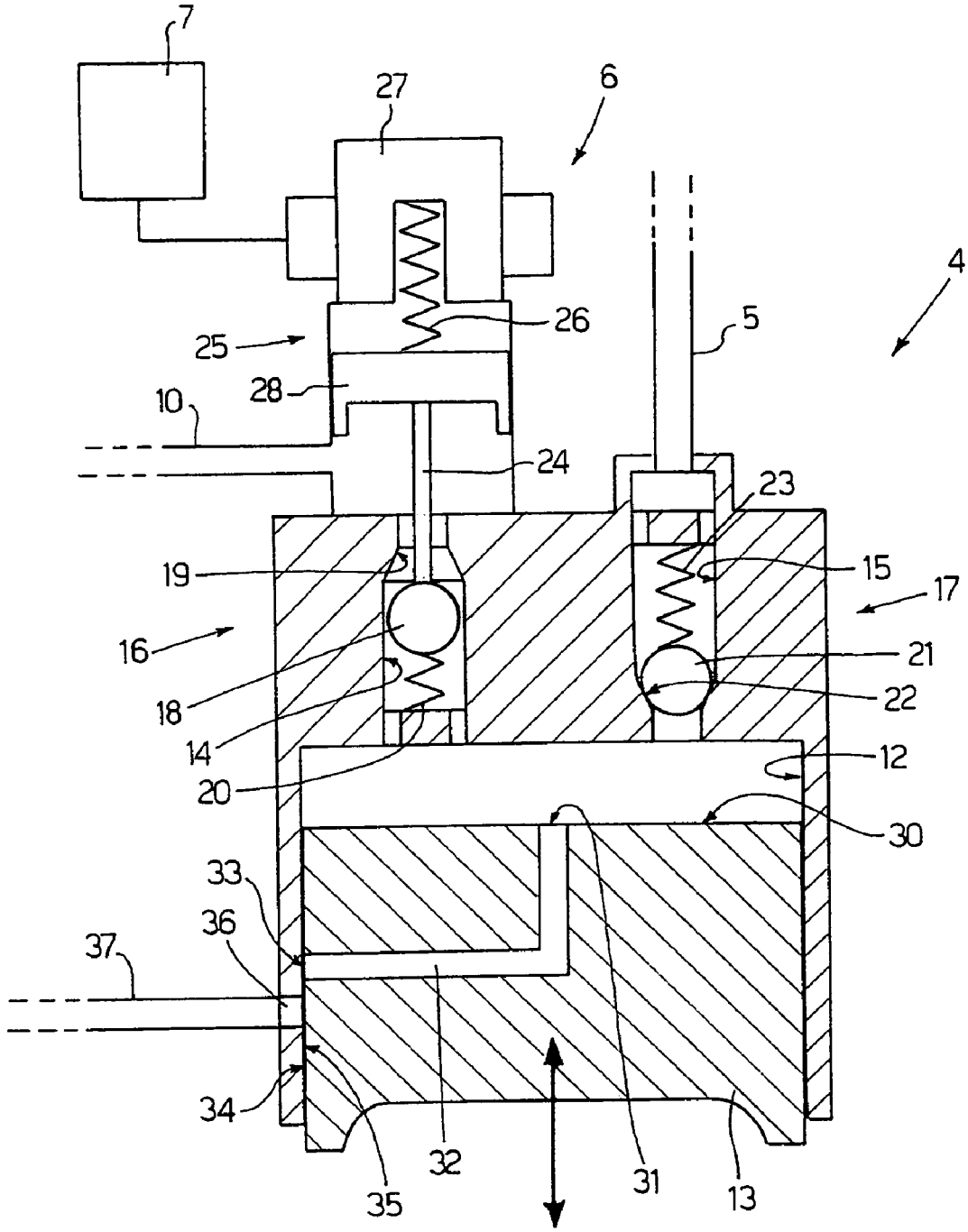
FIG. 2 is a diagrammatic, cross-sectional view of a high-pressure pump of the system in FIG. 1.

As shown in FIG. 2, the high-pressure pump 4 comprises a pair of cylinders 12 (only one of which is shown in FIG. 2), each of which is provided with a piston 13 with reciprocating motion within the cylinder 12 under the thrust of a mechanical transmission (known and not shown); in particular, said mechanical transmission takes its motion from a drive shaft (not shown) of the engine and is capable of causing each piston 13 to perform one cycle (i.e. an intake stroke and a pumping stroke) for every two revolutions of the drive shaft. Thus, for every two revolutions of the drive shaft, each cylinder 12 of the high-pressure pump 4 performs a compression phase or pump stroke and the high-pressure pump 4 performs two pump strokes; actuation of one piston 13 is shifted 360° out of phase relative to the actuation of the other piston 13, such that the pump strokes of the two pistons 13 are not superimposed on one another, but are symmetrically distributed so as to produce a compression phase or pump stroke of the high-pressure pump 4 on each revolution of the drive shaft.

On the crown of each cylinder 12, there is an intake channel 14 connected to the low-pressure pump 8 by means of the tube 10 and a delivery channel 15 connected to the common rail 3 by means of the tube 5. The intake channel 14 is controlled by a bidirectional intake valve 16, i.e. one that is capable of permitting fuel to pass both into and out of the cylinder 12, while the delivery channel 15 is regulated by a non-return delivery valve 17 that only permits fuel to flow out of the cylinder 12.

The intake valve 16 comprises a valve body 18 that is mobile along the intake channel 14 and a valve seat 19, which is capable of being acted upon in a fluid-tight manner by the valve body 18 and is located at the opposite end of the intake channel 14 from the end communicating with the cylinder 12; a spring 20 is capable of pushing the valve body 18 towards a position of fluid-tight engagement with the valve seat 19. The intake valve 16 is normally pressure-actuated, in that the forces arising from the pressure differences across the intake valve 16 are greater than the force generated by the spring 20; in particular, in the absence of external intervention, the intake valve 16 is closed when the pressure of the fuel within the cylinder 12 is greater than the pressure of the fuel within the tube 10 and is open when the pressure of the fuel within the cylinder 12 is lower than the pressure of the fuel within the tube 10.

The delivery valve 17 comprises a valve body 21 that is mobile along the delivery channel 15 and a valve seat 22, which is capable of being acted upon in a fluid-tight manner by the valve body 21 and is located at the opposite end of the delivery channel 15 from the end communicating with the cylinder 12; a spring 23 is capable of pushing the valve body 21 towards a position of fluid-tight engagement with the valve seat 22. The delivery valve 17 is pressure-actuated, in that the forces arising from the pressure differences across the delivery valve 17 are much greater than the force generated by the spring 23; in particular, in the absence of external intervention, the delivery valve 17 is open when the pressure of the fuel within the cylinder 12 is greater than the pressure of the fuel within the tube 5 (i.e. within the common rail 3) and is closed when the pressure of the fuel within the cylinder 12 is lower than the pressure of the fuel within the tube 5 (i.e. within the common rail 3).

The regulating device 6 is coupled to the intake valve 16 in order to permit the control unit 7 to keep the intake valve 16 open during a compression phase of the piston 13 and so permit fuel to flow out from the cylinder 12 through the intake channel 14. The regulating device 6 comprises an actuating rod 24, which is coupled to the valve body 18 of the intake valve 16 and is mobile along a linear path that is parallel to the direction of flow of the fuel through the intake channel 14; in particular, the actuating rod 24 is mobile between a passive position, in which it permits the valve body 18 to act in a fluid-tight manner upon the respective valve seat 19, and an active position, in which it does not permit the valve body 18 to act in a fluid-tight manner upon the respective valve seat 19. The regulating device 6 also comprises an electromagnetic actuator 25, which is coupled to the actuating rod 24 in order to displace said actuating rod 24 between the active position and the passive position. The electromagnetic actuator 25 in turn comprises a spring 26 capable of keeping the actuating rod 24 in the active position and an electromagnet 27 controlled by the control unit 7 and capable of displacing the actuating rod 24 into the passive position by magnetically attracting a ferromagnetic armature 28 integral with the actuating rod 24; in particular, when the electromagnet 27 is energised, the actuating rod 24 is drawn back into the stated passive position and the intake channel 14 can be closed by the intake valve 16.

The spring 26 of the electromagnetic actuator 25 exerts a greater force than the spring 20 of the intake valve 16 and thus, under resting conditions (i.e. in the absence of significant hydraulic forces and with the electromagnet 27 de-energised), the rod 24 is placed in the active position and the intake valve 16 is open (i.e. it is a normally open valve). In contrast, under resting conditions (i.e. in the absence of significant hydraulic forces), the delivery valve 17 is closed (i.e. it is a normally closed valve).

According to the embodiment shown in FIG. 2, the rod 24 rests against the valve body 18 of the intake valve 16, which is pushed towards the rod 24 by the action of the spring 20. According to a different embodiment, which is not shown, the rod 24 is integral with the valve body 18 and it is possible to dispense with the spring 20.

The regulating device 6 can be driven by the control unit 7 in order to bring the actuating rod 24 into the active position only when the pressure of the fuel within the cylinder 12 is at a relatively low level (substantially of the order of magnitude of the pressure provided by the low-pressure pump 8), because the electromagnetic actuator 25 is not absolutely capable of overcoming the pressure of the fuel generated by the pumping phase of the piston 13. In other words, the regulating device 6 can keep the actuating rod 24 in the active position, i.e. can keep the intake valve 16 open, only at the beginning of a pumping phase of the piston 13, but is not capable of bringing the actuating rod 24 into the active position, i.e. of opening the intake valve 16, during a pumping phase of the piston 13.

The control unit 7 can actuate the electromagnet 27 with a current pulse that is of limited duration and is constant (for example less than 2 msec with actuation of the piston 13 performed at 3000 rpm); in fact, once the electromagnet 27 has brought the actuating rod 24 into the passive position by attracting to itself the armature 28, the intake valve 16 closes and a comparatively very high pressure is generated almost instantaneously within the cylinder 12, said pressure exerting on the valve body 18 of the intake valve 16 a force that is considerably higher than that exerted by the spring 26 of the actuator 25. Thus, if ever the electromagnet 27 ceases to act, the spring 26 of the actuator 25 is not capable of reopening the intake valve 16 until the pressure within the cylinder 12 has fallen to a relatively low level, i.e. until the beginning of the subsequent intake phase of the piston 13. Actuating the electromagnet 27 with a current pulse that is of limited duration and is constant is distinctly advantageous, because it makes it possible to restrict the energy consumption of the electromagnet 27 to the essential minimum, it makes it possible to reduce the costs of the associated electric circuits, because they can be dimensioned so as to operate with very low dissipated levels of electrical energy, and it makes it possible to simplify the control circuit for the electromagnet 27.

According to a preferred embodiment, along the tube 10 downstream from the low-pressure pump 8 there is inserted an overpressure valve 29, which serves to discharge the fuel from the tube 10 to the tank 9 when the pressure within the tube 10 exceeds a preset threshold value owing to the reflux of fuel from the cylinder 12. The function of the overpressure valve 29 is to prevent the pressure within the tube 10 from reaching relatively high values that could over time bring about the failure of the low-pressure pump 8.

The upper surface 30 of each piston 13 is provided with an inlet opening 31 to a channel 32 that extends within the piston 13 and ends at an outlet opening 33 provided on the side surface 34 of said piston 13. The side surface 35 of the cylinder 12 is provided with a discharge port 36, which is connected to the fuel tank 9 by means of a discharge duct 37 and is positioned such that it is aligned with and opposite the outlet opening 33 of the channel 32 during the upstroke or downstroke of the piston 13. The position of the discharge port 36 is selected so that it is always covered by the side surface of the piston 13 even when said piston 13 is located at its bottom dead centre. The position of the outlet opening 33 of the channel 32 is selected such that the outlet opening 33 is opposite the discharge port 36 when the piston 13 is located halfway through the upstroke (and, obviously, halfway through the downstroke). According to another embodiment, not shown, the discharge duct 37 communicating with the discharge port 36 is regulated by a non-return discharge valve capable of only permitting fuel to flow out of the cylinder 12 towards the fuel tank 9.

In use, during the downstroke or intake stroke of each piston 13 within the cylinder 12, a vacuum is generated and a constant quantity of fuel equal to the capacity of the cylinder 12 is introduced into the cylinder 12 through the intake channel 14. Halfway through the downstroke of the piston 13, the outlet opening 33 of the channel 32 is located opposite the discharge port 36; however, under these conditions there is no appreciable passage of fuel through the discharge port 36 because the pressure of the fuel present in the upper part of the cylinder 12 is low and substantially similar to the pressure present within the fuel tank 9.

Once the piston 13 has reached its bottom dead centre, the upper part of the cylinder 12 is full of fuel and the piston 13 reverses the direction of its stroke, beginning its upstroke or compression stroke. There is more fuel present in the upper part of the cylinder 12 than is necessary in order to obtain the desired pressure value within the common rail 3; therefore, a proportion of the fuel present in the upper part of the cylinder 12 must be discharged so as to supply the common rail 3 with only the quantity of fuel necessary to achieve the desired pressure value within the common rail 3.

Figure 3:
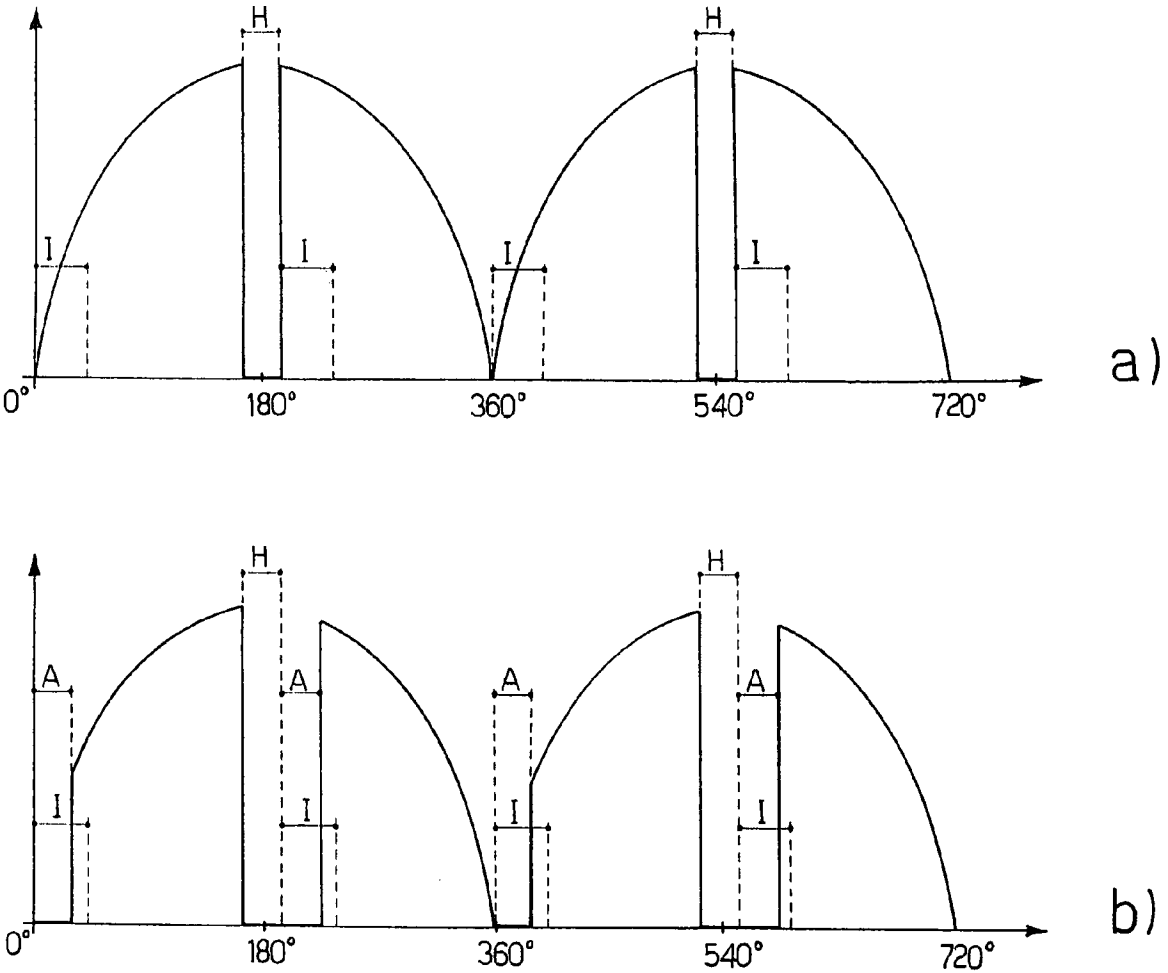
FIG. 3 shows graphs of the variation in flow rate of the high-pressure pump in FIG. 2 in different operating states.

FIGS. 3 show the pattern of the overall flow rate of the high-pressure pump 4 towards the common rail 3 as a function of engine angle, i.e. as a function of the angular position of the drive shaft, under two different operating conditions. In particular, FIG. 3*a* shows the case in which the control unit 7 does not act at all on the intake valve 16, which thus closes as soon as the piston 13 compresses the fuel present within the cylinder 12 to a pressure level greater than the pressure level present in the tube 10; subsequently, the pressure within the cylinder 12 rises further until it reaches levels such as to bring about the opening of the delivery valve 17 and so permit the fuel to be supplied under pressure from the cylinder 12 to the common rail 3. This situation is maintained until halfway through the upstroke of the piston when the outlet opening 33 of the channel 32 is located opposite the discharge port 36; at this point a proportion of the fuel present in the upper part of the cylinder 12 flows through the discharge duct 37 because the pressure of the fuel present in the upper part of the cylinder 12 is much higher than the pressure of the fuel in the discharge duct 37. Consequently, the pressure of the fuel within the cylinder 12 drops rapidly until it reaches levels close to the pressure of the fuel in the tube 10 and the delivery valve 17 accordingly closes. Said situation prevails while the outlet opening 33 of the channel 32 is in communication with the discharge port 36; as soon as the upstroke of the piston 13 moves the outlet opening 33 of the channel 32 away from the discharge port 36, the flow of fuel through the discharge duct 37 ceases and the pressure of the fuel within the cylinder 12 rises once more until the delivery valve 17 is reopened. When the piston 13 passes top dead centre and begins the downstroke or intake stroke, the pressure of the fuel within the cylinder 12 drops back down to low levels bringing about the closure of the delivery valve 17.

The situation explained above is clearly visible in FIG. 3*a*, in which the pattern of the flow rate of the high-pressure pump 4 towards the common rail 3 is shown as a function of engine angle (i.e. of the angular position of the drive shaft); in particular, the pattern of the flow rate of the high-pressure pump 4 towards the common rail 3 is shown during two successive complete revolutions of the drive shaft, i.e. over the course of 720° of engine revolution. In FIG. 3*a*, the effect of the channel 32 is clearly visible, producing a gap H in the flow rate of the high-pressure pump 4 towards the common rail 3 at around 180° and around 440°, i.e. corresponding to halfway through the upstroke of the pistons 13.

FIG. 3*a* shows the case in which the high-pressure pump 4 is required to supply the maximum possible quantity of fuel to the common rail 3, i.e. the case in which the control unit 7 does not act at all on the intake valve 16, which accordingly closes as soon as the piston 13 begins the upstroke. FIG. 3*b*, in contrast, shows the case in which the high-pressure pump 4 is required to supply a quantity of fuel to the common rail 3 that is less than the maximum possible quantity, i.e. the case in which the control unit 7 acts on the intake valve 16, which accordingly remains open for a certain angular choking interval A (corresponding to a certain time interval) during the upstroke of each piston 13 in order to permit a certain proportion of the fuel present in the cylinder 12 to be reintroduced into the tube 10. The duration of the angular choking interval A depends on the quantity of fuel to be supplied to the common rail 3 and can vary between a minimum of zero (as shown in FIG. 3*a*, corresponding to the case of maximum flow rate of the high-pressure pump 4 towards the common rail 3) and a maximum of approx. 180° (corresponding to the case of the intake valve 16 always being open and a zero flow rate of the high-pressure pump 4 towards the common rail 3).

In particular, during an initial phase of the upstroke, the control unit 7 does not permit closure of the intake valve 16, which accordingly remains open for the angular choking interval A; in this manner, the pressure within the cylinder 12 does not reach levels such as to allow the delivery valve 17 to open and a proportion of the fuel leaves the cylinder 12 towards the tube 10, flowing through the intake channel 14. Once the angular choking interval A has passed, the control unit 7 drives the regulating device 6 so as to bring the actuating rod 24 into the passive position and so permit closure of the intake valve 16 as a result of the consequent increase in the pressure of the fuel within the cylinder 12; at this point, the pressure within the cylinder 12 rises owing to the upstroke of the piston 13 until it reaches levels such as to bring about the opening of the delivery valve 17 and thus allow fuel to be supplied under pressure from the cylinder 12 to the common rail 3. Owing to the above-described action of the channel 32, halfway through the upstroke of the piston 13, the pressure of the fuel within the cylinder 12 drops distinctly, bringing about the closure of the delivery valve 17; before the pressure within the cylinder 12 begins to rise again, the control unit 7 again drives the regulating device 6 so as to bring the actuating rod 24 into the active position, bringing about the opening of the intake valve 16 for the angular choking interval A. A proportion of the fuel present within the cylinder 12 thus again leaves said cylinder 12 towards the tube 10 flowing through the intake channel 14. Once the angular choking interval A has passed, the control unit 7 drives the regulating device 6 so as to bring the actuating rod 24 into the passive position and so permit closure of the intake valve 16 as a result of the consequent increase in the pressure of the fuel within the cylinder 12; at this point, the pressure within the cylinder 12 rises owing to the upstroke of the piston 13 until it reaches levels such as to bring about the opening of the delivery valve 17 again and thus allow fuel to be supplied under pressure from the cylinder 12 to the common rail 3. When the piston 13 passes top dead centre and begins the downstroke or intake stroke, the pressure of the fuel within the cylinder 12 drops back down to low levels bringing about the closure of the delivery valve 17.

In other words, during any one pump stroke of each piston 13, i.e. during any one upstroke or compression stroke of the piston 13, delayed closure of the intake valve 16 in order to discharge fuel from the cylinder 12 to the tube 10 is repeated twice during the angular choking interval A: a first time at the beginning of the upstroke of the piston 13 and a second time halfway through the upstroke of the piston 13 immediately after the gap H caused by the channel 32.

As stated above, the regulating device 6 can be driven by the control unit 7 in order to bring the actuating rod 24 into the active position only when the pressure of the fuel within the cylinder 12 is at low levels (substantially of the order of magnitude of the pressure brought about by the low-pressure pump 8); the second opening of the intake valve 16 halfway through the upstroke of the piston 13 can only be achieved thanks to the presence of the channel 32, which brings about a substantial reduction in the pressure of the fuel within the cylinder 12 halfway through the upstroke of the piston 13.

In order to vary the quantity of fuel supplied by the high-pressure pump 4 to the common rail 3, i.e. in order to vary the average flow rate of the high-pressure pump 4, the control unit 7 varies the quantity of fuel discharged through the intake channel 14, i.e. it varies the moment at which it drives the regulating device 6 in order to displace the actuating rod 24 from the active position to the passive position, consequently varying the duration of the angular choking interval A; as stated above, the control unit 7 varies the moment at which the regulating device 6 is driven by means of a feedback control using as the feedback variable the fuel pressure level within the common rail 3, said pressure level being detected in real time by the sensor 11. As stated above, the duration of the angular choking interval A depends on the quantity of fuel to be supplied to the common rail 3 and can vary between a minimum of zero (as shown in FIG. 3*a*, which corresponds to the case of maximum flow rate of the high-pressure pump 4 towards the common rail 3) and a maximum of approx. 180° (corresponding to the case of the intake valve 16 always being open and a zero flow rate of the high-pressure pump 4 towards the common rail 3).

Each injector 2 performs its injection phase within an angular injection interval I, which typically has an amplitude of no greater than 40° of drive shaft revolution; in other words, depending on engine status, the injection phase of each injector 2 can be lengthened or shortened and can be advanced or delayed, but in each case the beginning and end of the injection (or the beginning of the first injection and the end of the final injection in the case of multiple injections) are always within an angular injection interval I that has an amplitude of no greater than 40° of drive shaft revolution.

As shown in FIG. 3, mechanical actuation of the high-pressure pump 4 is timed relative to the drive shaft so that two injection intervals I start at the beginning of the pumping phases (i.e. at 0° and 360° of drive shaft revolution) and so that two injection intervals I start halfway through the pumping phases just after the gap H (i.e. at approx. 180° and approx. 440° of drive shaft revolution). In this manner, it is obvious that where the pump strokes are not choked (FIG. 3*a*), all four of the injectors 2 perform injection while the piston 13 of the high-pressure pump 4 is pumping fuel into the common rail 3; on the other hand, where the pump strokes are choked (FIG. 3*b*), all four of the injectors 2 perform injection while the piston 13 of the high-pressure pump 4 is not pumping fuel into the common rail 3 or while the piston 13 of the high-pressure pump 4 is pumping fuel into the common rail 3, depending on the duration of the angular choking interval A. In each situation, all four of the injectors 2 always inject under identical general conditions with obvious benefits in terms of simplicity and efficiency of control of said injectors 2.

An alternative embodiment provides for timing of the mechanical actuation of the high-pressure pump 4 relative to the drive shaft so that two injection intervals I finish halfway through the pumping phases immediately before the gap H (i.e. at approx. 180° and approx. 440° of drive shaft revolution) and so that two injection intervals I finish at the end of the pumping phases (i.e. at 360° and 720° of drive shaft revolution); this embodiment places the emphasis on causing the injectors 2 to inject while the piston 13 of the high-pressure pump 4 is pumping fuel into the common rail 3.

Figure 4:
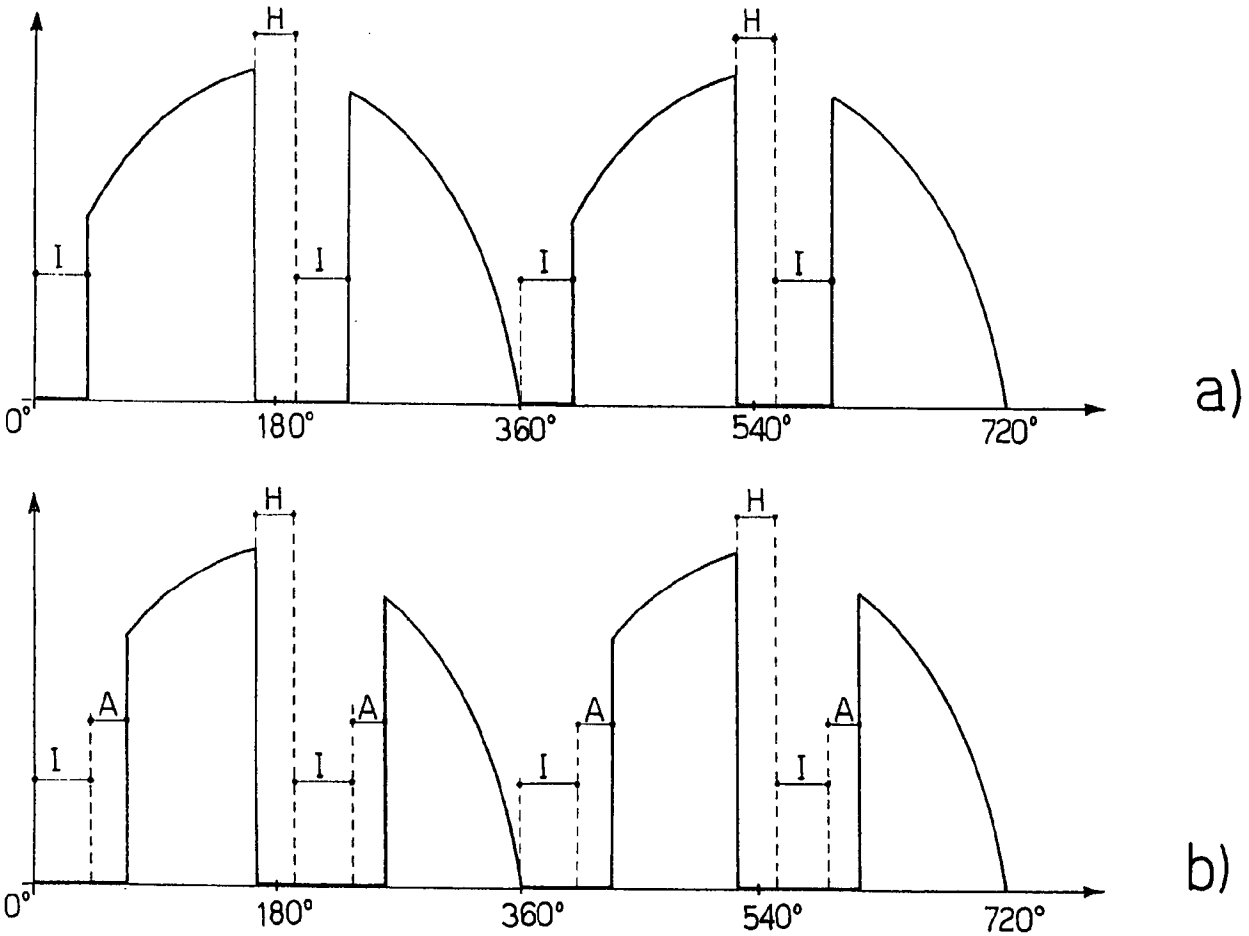
FIG. 4 shows graphs of the variation in flow rate of the high-pressure pump in FIG. 2 in different operating states and in accordance with a different embodiment of the control strategies.

According to another embodiment shown in FIG. 4, the cylinder capacity of the high-pressure pump 4 is oversized relative to the embodiment described above and shown in FIG. 3 and it is decided always to delay closure of the intake valve 16 by at least an angular interval equal to the angular injection interval I under each operating condition; in other words, irrespective of the quantity of fuel to be supplied to the common rail 3, the closure time of the intake valve 16 is always delayed by at least an angular interval equal to the angular injection interval I. FIG. 4*a* shows the operation of the high-pressure pump 4 corresponding to supplying the common rail 3 with the maximum possible quantity of fuel; in this situation, the closure time of the intake valve 16 is delayed by an angular interval equal to the angular injection interval I. FIG. 4*b* shows the operation of the high-pressure pump 4 corresponding to supplying the common rail 3 with a quantity of fuel that is less than the maximum possible quantity of fuel; in this situation, the closure time of the intake valve 16 is delayed by an angular interval greater than the angular injection interval I and in particular by an overall angular interval equal to the sum of the angular injection interval I and an angular choking interval A. By proceeding in accordance with the situation in FIG. 4, all the injectors 2 always perform injection while the piston 13 of the high-pressure pump 4 is not pumping fuel into the common rail 3, irrespective of whether the pump stroke of the high-pressure pump 4 is or is not choked. The advantages of this embodiment are immediately obvious, in that because the injectors 2 always perform injection while the piston 13 of the high-pressure pump 4 is not pumping fuel, it is possible to make control of said injectors 2 simpler and more efficient.

The embodiments shown in FIGS. 1–4 relate to an engine having four cylinders and thus four injectors 2. Where an engine has a larger number of cylinders, for example six or eight cylinders, and thus a larger number of injectors 2, it is possible to have two or three discharge ports 36 mutually symmetrically arranged along the side surface 35 of the piston 13 so as to create two or three gaps H in each pump stroke of the high-pressure pump 4; in this manner, it is possible to subdivide the choking of the pump stroke symmetrically into three or four phases, the first of which being at the beginning of the pump stroke and the others after each gap H.

Figure 5:
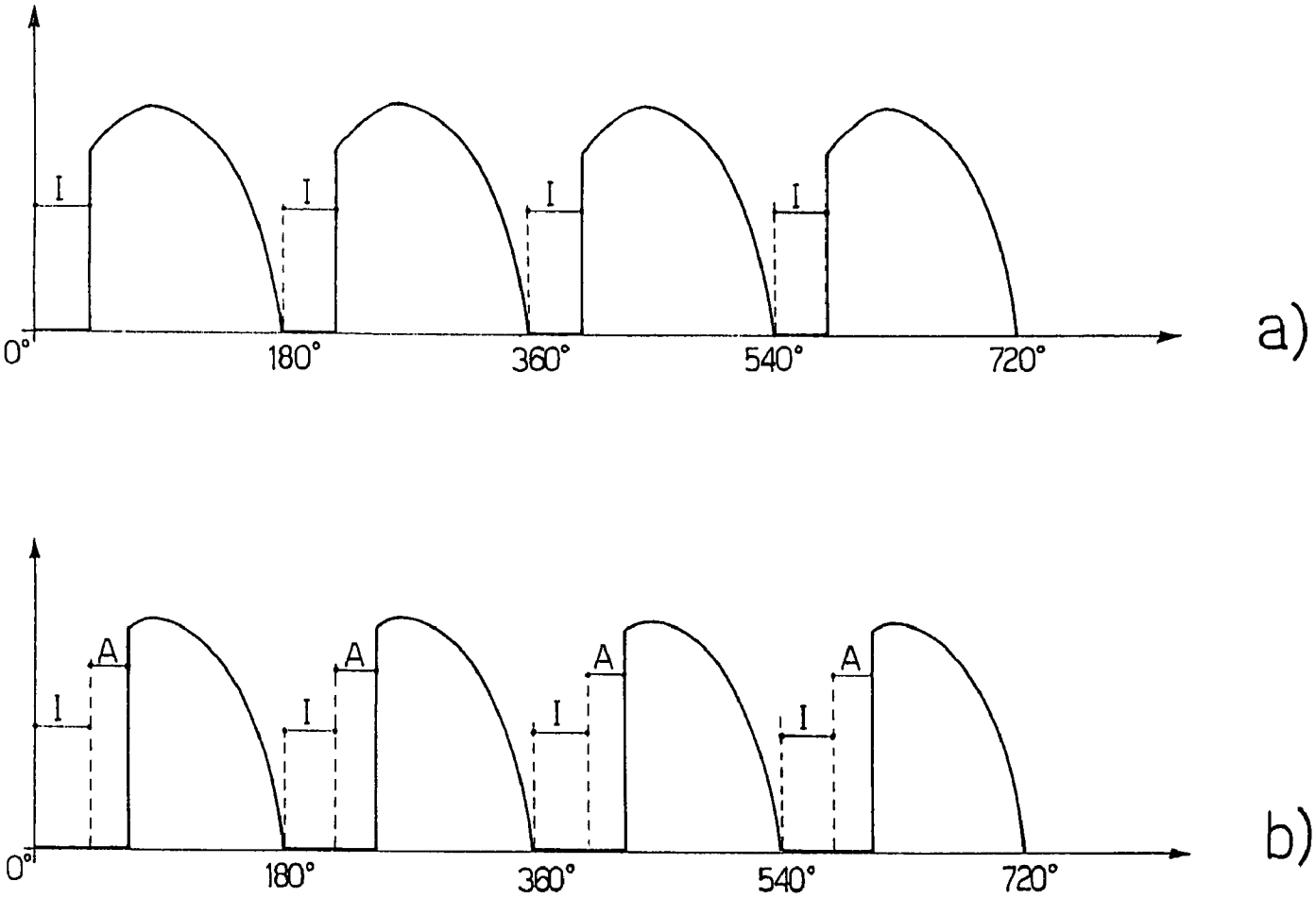
FIG. 5 shows graphs of the variation in flow rate in different operating states of a high-pressure pump produced according to a different embodiment.

According to a further embodiment shown in FIG. 5, the high-pressure pump 4 comprises four cylinders 12, each of which is provided with a piston 13 that has an alternating motion within the cylinder 12 under the thrust of the mechanical transmission (known and not shown); in particular, said mechanical transmission takes its motion from the drive shaft (not shown) of the engine and is capable of causing each piston 13 to perform one cycle (i.e. an intake stroke and a pumping stroke) for every two revolutions of the drive shaft. Thus, for every two revolutions of the drive shaft, each cylinder 12 performs a pump stroke and the high-pressure pump 4 makes four pump strokes; actuation of each piston 13 is shifted out of phase by a multiple of 180° relative to the actuation of the other pistons 13, such that the four pump strokes are not superimposed on one another, but are symmetrically distributed so as to obtain a pump stroke of the high-pressure pump 4 on each half revolution of the drive shaft.

As shown in FIG. 5, since there are four pump strokes of the high-pressure pump 4 for every two revolutions of the drive shaft, the presence of the channel 32 is no longer necessary because the injection of a single injector 2 corresponds to each pump stroke of the high-pressure pump 4. In a similar manner to that already stated for the embodiment in FIG. 4, it is decided always to delay closure of the intake valve 16 by at least an angular interval equal to the angular injection interval I under each operating condition; in other words, irrespective of the quantity of fuel to be supplied to the common rail 3, the closure time of the intake valve 16 is always delayed by at least an angular interval equal to the angular injection interval I. FIG. 5*a* shows the operation of the high-pressure pump 4 corresponding to supplying the common rail 3 with the maximum possible quantity of fuel; in this situation, the closure time of the intake valve 16 is delayed by an angular interval equal to the angular injection interval I. FIG. 5*b* shows the operation of the high-pressure pump 4 corresponding to supplying the common rail 3 with a quantity of fuel that is less than the maximum possible quantity of fuel; in this situation, the closure time of the intake valve 16 is delayed by an angular interval greater than the angular injection interval I and in particular by an overall angular interval equal to the sum of the angular injection interval I and an angular choking interval A. By proceeding in accordance with the situation shown in FIG. 5, all the injectors 2 always perform injection while the piston 13 of the high-pressure pump 4 is not pumping fuel into the common rail 3, irrespective of whether the pump stroke of the high-pressure pump 4 is or is not choked. The advantages of this embodiment are immediately obvious, in that because the injectors 2 always perform injection while the piston 13 of the high-pressure pump 4 is not pumping fuel, it is possible to make control of said injectors 2 simpler and more efficient.

The invention claimed is:

1. Method for the direct injection of fuel into an internal combustion engine, in which a high-pressure pump with a variable flow rate supplies the fuel to a common rail, which in turn supplies the fuel to a series of injectors, each of which performs its injection phase within an angular injection interval; the high-pressure pump comprising a number of cylinders, each of which is provided with a piston, an intake valve and a delivery valve; the method comprising:

that each cylinder of the high-pressure pump is supplied with a substantially constant quantity of fuel during each intake phase, that the flow rate of the high-pressure pump is regulated by choking the pump stroke of each cylinder of the high-pressure pump so as to supply to the common rail a variable fraction of the fuel present in said cylinder at the end of the intake phase, and that a choking action of a pump stroke is performed for each injection phase of an injector;

wherein the mechanical actuation of the high-pressure pump is timed so that each injection interval is located at the beginning of a respective choking action and that each pump stroke is choked by at least an angular interval having a duration no shorter than that of the injection intervals irrespective of the quantity of fuel to be supplied to the common rail in such a way that the injection phase of each injector always takes place when the high-pressure pump is not pumping fuel to the common rail.

2. Method according to claim 1, wherein the high-pressure pump performs on each revolution of a drive shaft a number of pump strokes equal to the number of injectors that perform injection during a single revolution of the drive shaft.

3. Method according to claim 2, wherein the high-pressure pump comprises a number of cylinders equal to the number of injectors.

4. Method according to claim 1, wherein the high-pressure pump performs, on each revolution of a drive shaft, a number of pump strokes that is a submultiple, in particular half, of the number of injectors that perform injection during a single revolution of the drive shaft; there being generated for the pump stroke of each cylinder of the high-pressure pump at least one intermediate gap in said pump stroke during which the pumping pressure is substantially reduced to zero; and choking of a single pump stroke of each cylinder of the high-pressure pump being subdivided symmetrically into at least a first choking action associated with the injection phase of a first injector and into a second choking action associated with the injection phase of a second injector.

5. Method according to claim 4, wherein during any one pump stroke of each cylinder of the high-pressure pump, the first choking action is performed at the beginning of the pump stroke and the second choking action is performed immediately after the intermediate gap; mechanical actuation of the high-pressure pump being timed so that the injection intervals are arranged at the beginning of a pump stroke or immediately after an intermediate gap.

6. Method according to claim 1, wherein the pump stroke of each cylinder of the high-pressure pump is choked by varying the closure time of the intake valve of said cylinder.

7. Method according to claim 6, wherein a regulating device is coupled to the intake valve in order to keep the intake valve open during a compression phase of the piston and so permit fuel to flow back out of the cylinder through said intake valve; the intake valve comprising a mobile valve body and a valve seat, which is capable of acting in a fluid-tight manner upon the valve body; the regulating device comprising an actuating body, which is coupled to the valve body and can move between a passive position, wherein it permits the valve body to act in a fluid-tight manner upon the valve seat, and an active position, wherein it does not permit the valve body to act in a fluid-tight manner upon the valve seat.

8. Method according to claim 7, wherein the regulating device comprises an electromagnetic actuator, which is coupled to the actuating element (24) in order to displace said actuating element between the passive position and the active position; the electromagnetic actuator comprising a spring capable of keeping the actuating element in the active position and an electromagnet capable of displacing the actuating element into the passive position.

9. Method according to claim 8, wherein the electromagnetic actuator is controlled by means of a current pulse of constant duration and of a relatively low level.

10. A system for the direct injection of fuel into an internal combustion engine; the system comprising a high-pressure pump with a variable flow rate and a common rail which is supplied by the high-pressure pump and in turn supplies a series of injectors; the high-pressure pump (4) comprising a number of cylinders, each of which is provided with a piston, an intake valve and a delivery valve; the system further comprising:

that each cylinder of the high-pressure pump is supplied with a substantially constant quantity of fuel during each intake phase and that the flow rate of the high-pressure pump is regulated by choking the pump stroke of each cylinder of the high-pressure pump so as to supply to the common rail a variable fraction of the fuel present in said cylinder at the end of the intake phase;

that a choking action of a pump stroke is performed for each injection phase of an injector;

wherein the mechanical actuation of the high-pressure pump is timed so that each injection interval is provided at the beginning of a respective choking action and that each pump stroke is choked by at least an angular interval having a duration no less than that of the injection intervals irrespective of the quantity of fuel to be supplied to the common rail so that the injection phase of each injector always takes place when the high-pressure pump is not pumping fuel to the common rail.

* * * * *